United States Patent [19]

Allam et al.

[11] Patent Number: 4,715,902

[45] **Date of Patent: * Dec. 29, 1987**

[54] PROCESS FOR APPLYING THERMAL BARRIER COATINGS TO METALS AND RESULTING PRODUCT

[75] Inventors: Ibrahim M. Allam, Menlo Park; David J. Rowcliffe, Los Altos, both of Calif.

[73] Assignee: S R I International, Menlo Park, Calif.

[ * ] Notice: The portion of the term of this patent subsequent to Nov. 20, 2001 has been disclaimed.

[21] Appl. No.: 719,685

[22] Filed: Apr. 4, 1985

Related U.S. Application Data

[63] Continuation of Ser. No. 487,745, Apr. 22, 1984, abandoned, and a continuation-in-part of Ser. No. 662,252, Oct. 17, 1984, abandoned, and a continuation-in-part of Ser. No. 662,253, Oct. 17, 1984, and a continuation-in-part of Ser. No. 325,504, Nov. 27, 1981, Pat. No. 4,483,720.

[51] Int. Cl.[4] ..... C23C 8/10

[52] U.S. Cl. ..... 148/6.3; 148/6.35

[58] Field of Search ..... 148/6.3, 6.35

[56] References Cited

FOREIGN PATENT DOCUMENTS 2110721 6/1983 United Kingdom ..... 148/63

*Primary Examiner*—Sam Silverberg

*Attorney, Agent, or Firm*—Edward B. Gregg; Urban H. Faubion; John Y. Chen

[57] ABSTRACT

Process for applying a protective coating to a metal substrate which provides a thermal barrier and a barrier against oxidation of the substrate. The coating material is a mixture of (1) zirconium and/or hafnium and (2) a metal such as nickel which does not form a stable oxide at a high temperature in an atmosphere having a very low concentration of oxygen. The coating is subjected to such conditions to produce an outer oxide layer of metal zirconium and/or hafnium and an inner metal layer of the second metal alloyed with one or more components of the substrate. The oxide layer provides thermal and oxidation protection and the inner layer bonds the coating to the substrate.

7 Claims, No Drawings

PROCESS FOR APPLYING THERMAL BARRIER COATINGS TO METALS AND RESULTING PRODUCT

ORIGIN OF INVENTION

This invention was made with Government support under Air Force Office of Scientific Research Contract No. F 49620-81-K-009 awarded by the United States Air Force. The Government has certain rights in this invention.

This application is a continuation of Ser. No. 487,745 filed Apr. 22, 1984 now abondoned. This application is a continuation-in-part of the following copending applications: Application Ser. No. 662,252, filed Oct. 17, 1984, entitled "PROCESS FOR APPLYING HARD COATINGS AND THE LIKE TO METALS AND RESULTING PRODUCT" now abandoned; application Ser. No. 662,253, filed Oct. 17, 1984, entitled "PROCESS FOR APPLYING THERMAL BARRIER COATINGS TO METALS"; and Application Ser. No. 325,504, filed Nov. 27, 1981, now U.S. Pat. No. 4,483,720.

This invention relates to the coating of metals, particularly certain alloys, with a protective coating that acts as a thermal or oxidative barrier.

Certain alloys known as "superalloys" are used as gas turbine components where high temperature oxidation resistance and high mechanical strengths are required. In order to extend the useful temperature range, the alloys must be provided with a coating which acts as a thermal barrier to insulate and protect the underlying alloy or substrate from high temperatures and oxidizing conditions to which they are exposed.

Zirconium oxide is employed for this purpose because it has a thermal expansion coefficient approximating that of the superalloys and because it functions as an efficient thermal barrier.

Zirconium oxide has heretofore been applied to alloy substrates by plasma spraying. The zirconium oxide forms an outer layer or thermal barrier and the zirconium oxide is partially stabilized with a second oxide such as calcium, magnesium or yttrium oxide. The plasma spray technique often produces nonuniform coatings and it is not applicable or is difficulty applicable, to re-entrant surfaces. The plasma sprayed coatings often have microcracks and pinholes and the adherence between the coating and substrate can be poor. All of these effects can lead to catastrophic failure.

Thermal barrier coatings can also be applied using sputtering or electron beam vaporization. These methods of application are expensive and limited to line of sight application. Variations in coating compositions often occur during electron beam vaporization because of differences in vapor pressures of the coating constituent elements. Sputtering produces fibrous and segmented structures which can be penetrated by the corrosive species.

In copending U.S. patent application Ser. No. 325,504 filed Nov. 27, 1981 entitled "PROCESS FOR APPLYING THERMAL BARRIER COATINGS TO METALS AND THE RESULTING PRODUCT" there is described a method of applying thermal barrier coatings to substrate metals such as superalloys in which the free metal whose oxide is to become the thermal barrier is applied to the substrate metal as a physical mixture or as an alloy with another metal such as nickel or cobalt and the coating of metal is subjected to selective oxidation by exposure at a high temperature to an atmosphere having a very low partial pressure of oxygen. Under these conditions the metal whose oxide is to provide the thermal barrier, called $M_1$, forms a stable oxide but the other metal, called $M_2$does not form a stable oxide. As a result a layer or coating of oxide of $M_1$ and the free metal $M_2$ is formed. The oxide of $M_1$ provides the thermal barrier and the free metal $M_2$ serves to bond the oxide to the substrate metal.

This process, often called dip coating because it is advantageously carried out by dipping the articles to be coated into a molten alloy of $M_1$ and $M_2$, is easier to carry out than coatings with a metal oxide by the plasma method and the resulting coat is more adherent and is a better thermal barrier.

In accordance with the present invention, an alloy or a physical mixture of (1) the metal $M_2$ and (2) zirconium, hafnium or a mixture or alloy of the two metals is provided. In the case where the second metal is zirconium, additions of metals such as yttrium, calcium or magnesium can be made in quantities that are sufficient to stabilize zirconium oxide in the cubic form. The metal $M_2$ is selected in accordance with the criteria described below. This alloy or metal mixture is then melted to provide a uniform melt which is then applied to a metal substrate by dipping the substrate in the melt. Alternatively, the metal mixture or alloy is reduced to a finely divided state, and the finely divided metal is incorporated in a volatile solvent to form a slurry which is applied to the metal substrate by spraying or brushing. The resulting coating is heated to accomplish evaporation of the volatile solvent and the fusing of the alloy or metal mixture onto the surface of the substrate. (Where physical mixtures of metals are used, they are converted to an alloy by melting or they are alloyed in situ in the slurry method of application.)

Zirconium and hafnium form thermally stable oxides when exposed to an atmosphere containing a small concentration of oxygen such as that produced by a mixture of carbon dioxide and carbon monoxide at a temperature of about 800° C. The metal $M_2$, under such conditions, does not form a stable oxide and remains entirely or substantially entirely in the form of the unoxidized metal. Further, $M_2$ is compatible with the substrate metal. It will be understood that $M_2$ may be a mixture or an alloy of two or more metals meeting the requirements of $M_2$.

Zirconium and hafnium have one or more of the following advantages over cerium and other lanthanide metals: The coatings are considerably more adherent to the substrate. When cerium is used, unoxidized metal from the substrate tends to become incorporated in the oxide layer. This metal may then be oxidized when the coated article is exposed to an oxidizing atmosphere. This leads to spallation and ultimate fracture of the coating. When zirconium is used rather than cerium, this difficulty is not encountered or is encountered in much lesser degree.

When a coating of suitable thickness has been applied to the substrate alloy by the dip coating process or by the slurry process described above (and in the latter case after the solvent has been evaporated and the zirconium and/or hafnium-$M_2$ alloy or mixture is fused onto the surface of the substrate) the surface is then exposed to a selectively oxidizing atmosphere such as a mixture of carbon dioxide and carbon monoxide (hereinafter referred to as $CO_2/CO$). A typical $CO_2/CO$ mixture contains 99 percent of $CO_2$ and 1 percent of CO. When such a mixture is heated to a high temperature, an equilibrium mixture results in accordance with the following equation:

$$Co+\frac{1}{2}O_2 \rightleftharpoons CO_2$$

The concentration of oxygen in this equilibrium mixture is very small, e.g., at 827° C. the equilibrium oxygen partial pressure is approximately $2\times10^{-14}$ atmosphere, but is sufficient at such temperature to bring about selective oxidation of zirconium and/or hafnium. Other oxidizing atmospheres may be used, e.g., mixtures of oxygen and inert gases such as argon or mixtures of hydrogen and water vapor which provide oxygen partial pressures lower than the dissociation pressures of the oxides of the elements in $M_2$, and higher than the dissociation pressure of zirconium oxide and hafnium oxide. A mixture of hydrogen, water vapor and an inert gas such as argon is indeed preferred because it will not produce an unwanted carbide. Such carbides may result at elevated temperatures, e.g. at 627° C., by reason of the Boudouard reaction:

$$2CO \rightleftharpoons C+CO_2$$

The metal $M_2$ is, depending upon the type of service and the nature of the substrate alloy, preferably selected from Table I.

TABLE I

| ($M_2$) | |
|---|---|
| Nickel | Ni |
| Cobalt | Co |
| Iron | Fe |

It will be understood that two or more metals chosen from Table I may be employed to form the $M_2$ component of the coating alloy or mixture. In such alloys or mixtures minor amounts of aluminum, yttrium and/or chromium may be present. In general any metal $M_2$ may be used which does not form a stable oxide at a high temperature in the presence of a very small concentration of oxygen, which serves to bond the zirconium and/or hafnium oxide to the substrate and which is suitable for the intended type of service. These also include platinum, palladium, ruthenium or rhodium.

Proportions of zirconium, hafnium (or mixtures or alloys of both) and $M_2$ may vary from about 50 to 90% by weight of zirconium and/or hafnium to from about 50 to 10% by weight of $M_2$, preferably about 70 to 90% of zirconium and/or hafnium and about 30 to 10% of $M_2$. The alloy resulting from a mixture of zirconium and/or hafnium with $M_2$ (plus any minor alloying additions) must have a melting point that is sufficiently low that the properties of the substrate alloy are not degraded by being exposed to the dipping temperature. The proportion of zirconium and/or hafnium should be sufficient to form an outer oxide layer sufficient to provide a thermal barrier and to inhibit oxidation of the substrate and the proportion of $M_2$ should be sufficient to bond the coating to the substrate.

Table II provides examples of substrate alloys to which the protective coatings are applied in accordance with the present invention. It will be noted that the invention may be applied to superalloys in general and specifically to cobalt and nickel based superalloys.

TABLE II

| | |
|---|---|
| Nickel Base Superalloy | IN 738 |
| Cobalt Base Superalloy | MAR-M509 |
| NiCrAlY Type Bond Coating Alloy | |
| CoCrAlY Type Bond Coating Alloy | |

The invention may also be applied to any metal substrate which benefits from a coating which is adherent and which provides a thermal barrier and/or protection from oxidation by the ambient atmosphere. The metal or metals of the substrate should, of course, be nobler than zirconium or hafnium such that they do not form stable oxides under the conditions of selective oxidation.

The dip coating method is preferred. In this method a molten zirconium and/or hafnium-$M_2$ alloy is provided and the substrate alloy is dipped into a body of the coating alloy. The temperature of the alloy and the time during which the substrate is held in the molten alloy will control the thickness of the coating. The thickness of the applied coating can range between 100 micrometers to 1000 micrometers. Preferably, a coating of about 300 micrometers to 400 micrometers is applied. It will be understood that the thickness of the coating will be provided in accordance with the requirements of a particular end use.

The slurry fusion method has the advantage that it dilutes the coating alloy or metal mixture and therefore makes it possible to effect better control over the thickness of coating applied to the substrate. Typically, the slurry coating technique may be applied as follows: An alloy or a mixture of zirconium and/or hafnium with $M_2$ is mixed with a mineral spirit and an organic cement such as Nicrobraz 500, (Well Colmonoy Corp.) and MPA-60 (Baker Coaster Oil Co.). Typical proportions used in the slurry are coating metal 45 weight percent, mineral spirit 10 weight percent, and organic cement 45 weight percent. This mixture is then ground, for example, in a ceramic ball mill using aluminum oxide balls. After separation of the resulting slurry from the alumina balls, it is applied (keeping it stirred to insure uniform dispersion of the particles of alloy in the liquid medium) to the substrate surface and the solvent is evaporated, for example, in air at ambient temperature or at a somewhat elevated temperature. The residue of metal and cement is then fused onto the surface by heating it to a suitable temperature, for example, 1000° C. in an inert atmosphere such as argon that has been passed over hot calcium chips to getter oxygen. The cement will be decomposed and the products of decomposition are volatilized.

The following specific example will serve further to illustrate the practice and advantages of the invention.

EXAMPLE 1

The coating alloy composition was 70% Zr-25% Ni-5% Y by weight. Yttrium was added to the Zr-Ni coating alloy to provide a dopant to stabilize $ZrO_2$ in the cubic structure during the selective oxidation stage, and also because there is some evidence that yttrium improves the adherence of plasma-sprayed $ZrO_2$ coatings. The weight ratio of Zr to Ni in this alloy was 2.7, which is similar to that of the $NiZr_2$- NiZr eutectic composition. The 5% Y did not significantly alter the melting temperature of the Zr-Ni eutectic. The substrates were dipped into the molten coating alloy at 1027° C.

Two substrate alloys were coated, namely MAR-M509 and Co- 10% Cr-3% Y. The results obtained indicate that the $ZrO_2$-based coatings applied by this technique are highly adherent, uniform and have very low porosity. Virtually no diffusion zone was observed between the coating and the substrate alloy. The coating layer was established totally above the substrate surface, and its composition was not significantly altered by the substrate constituents.

EDAX-concentration profiles were determined of different elements within the Zr-rich layer after hot dipping the substrate alloy (Co-10Cr-3Y) in the coating alloy, followed by an annealing treatment. The coating layer was about 150–160 μm thick with a relatively thin (=20 μm) diffusion zone at the interface with the underlying substrate. Cr was virtually nonexistent within the coating layer and a small amount of Co diffused from the substrate right through the coating to the external surface.

Selective oxidation was conducted at 1027° C. in a gas mixture of hydrogen/water vapor/argon at appropriate proportions to provide an oxygen partial pressure of about $10^{-17}$ atm. At this pressure, both nickel and cobalt are thermodynamically stable in the metallic form. The scale produced by this process consists of an outer oxide layer about 40 μm thick and an inner subscale composite layer of about 120 μm thick. The outer layer contained only $ZrO_2$ and $Y_2O_3$. The subscale also consisted of a $ZrO_2/Y_2O_3$ matrix, but contained a large number of finely dispersed metallic particles, essentially nickel and cobalt.

Although nickel and cobalt were present uniformly within the outer region of the metallic coating after hot dipping and annealing and before the conversion of Zr and Y into oxides, they were virtually absent from this same region after the selective oxidation treatment. X-ray diffraction analysis of the surface of the sample indicated that this outer oxide layer was formed exclusively of a mixture of monoclinic zirconia and yttria.

It is believed that the final distribution of elements across the duplex coating layer and the subsequent oxide morphology are determined largely by the conditions of the final selective oxidation treatment. We believe that oxidation proceeds as follows: The melt composition at the sample surface before the selective oxidation treatment consists largely of Zr and Ni, smaller concentrations of Y and Co, and virtually no Cr. Once oxygen is admitted at $P_{O2}=10^{-17}$ atm, Zr and Y atoms diffuse rapidly in the melt toward the outer oxygen/-metal interface to form a solid $ZrO_2/Y_2O_3$ mixture. The more noble elements (Ni and Co) are then excluded from the melt and accumulate in the metal side of the interface. The depletion of Zr from this melt increases the nickel content of the alloy and renders it more refractory. Once the coating alloy solidifies, atoms of all elements in the remaining metallic part of the coating become less mobile than in the molten state, and further oxidation proceeds as a solid state reaction. The continued growth of the $ZrO_2/Y_2O_3$ continues to promote a counter-current solid state diffusion process in the metal side of the interface in which Zr and Y diffuse toward the interface, while nickel and cobalt diffuse away from the interface.

The profile indicated that, under the external $ZrO_2$-$/Y_2O_3$ layer, nickel and cobalt exist as small particles embedded in the subscale composite layer. The reason for their existence in such a distribution within a matrix of the $ZrO_2/Y_2O_3$ subscale is not well understood. It should be emphasized that the weight fraction of nickel present in the coating layer, before oxidation, amounts to about 25%, which corresponds to about 20% in volume fraction. This amount will increase in the subscale after the exclusion of nickel from the outer $ZrO_2/Y_2O_3$ external scale during selective oxidation. This substantial amount of nickel, added to cobalt diffusing from the substrate, is expected to remain trapped in the subscale layer of the coating during the completion of selective oxidation of Zr and Y.

The configuration and distribution of nickel and cobalt within this zone is likely to be determined by the mechanisms of oxidation of Zr and Y within the subscale zone. At least two possibilities exist:

(1) The concentration of nickel and cobalt in the metal ahead of the interface becomes very high as a result of their exclusion from the $ZrO_2/Y_2O_3$ scale initially formed from the melt. Some back-diffusion of both elements in the solid state is likely to continue during further exposure, but the remaining portion of both elements may be overrun by the advancing oxide/-metal interface.

(2) A transition from internal to external oxidation occurs. After the initial formation of a $ZrO_2/Y_2O_3$ layer at the surface, $ZrO_2$ internal oxide particles may form ahead of the interface when the concentration of dissolved oxygen and zirconium exceeds the solubility product necessary for their nucleation. Then, these particles may partially block further Zr-O reaction because the diffusion of oxygen atoms to the reaction front (of internal oxidation) can occur only in the channels between the particles that were previously precipitated. Further reaction at the reaction front may occur either by sideways growth of the existing particles, which requires a very small supersaturation, or by nucleation of a new particle. The sideways growth of the particles can thus lead to a compact oxide layer, which can entrap metallic constituents existing within the same region.

In general, regardless of the mechanism involved, in determining the morphology and distribution of the metallic particles within the subscale zone, the formation of such a ceramic/metallic composite layer between the outer ceramic layer and the inner metallic substrate is highly advantageous. This is due to its ability to reduce the stresses generated from the mismatch in coefficients of thermal expansion of the outer ceramic coating and the inner metallic substrate.

Coating adhesion was evaluated by exposure of several test specimens to 10 thermal cycles between 1000° C. and ambient temperature in air. The $ZrO_2/Y_2O_3$ coating on the alloy Co-10Cr-3Y remained completely adherent and showed no sign of spallation or cracking. Careful metallurgical examination along the whole length of the specimen did not reveal any sign of cracking. The coating appears completely pore free. Furthermore, microprobe analyses across this section showed that the distributions of Zr, Y, Ni, Co, and Cr were essentially the same as those samples that had not been cycled. The coatings are not equally effective on all substrates. For example, a similar $ZrO_2/Y_2O_3$ coating on the alloy MAR-M509 spalled after the second cycle.

It will therefore be apparent that a new and advantageous method and product are provided.

We claim:

1. A method of coating a metal substrate with a protective coating which comprises:

(a) providing a substrate metal to be coated, (b) providing an alloy or mixture of (1) zirconium and/or hafnium, and (2) at least one other metal $M_2$ which does not form a stable oxide at an elevated temperature in an atmosphere having a very small partial pressure of oxygen, and which forms an alloy with at least one component of the substrate on heat treatment of the coated material, the zirconium and/or hafnium constituting not less than 50% by weight of the alloy or mixture, $M_2$ being present in substantial amount but not exceeding 50% by weight of the alloy or mixture, (c) applying such alloy or mixture to a surface of the substrate (1) by dipping the substrate in a molten alloy or mixture of zirconium and/or hafnium and $M_2$ or (2) by applying a slurry in a volatile liquid of zirconium and/or hafnium and $M_2$ in finely divided form either as the separate metals or as an alloy of the metals, then vaporizing the solvent and fusing the metals;

(d) effecting selective oxidation of the zirconium and/or hafnium at an elevated temperature in the coating without substantial oxidation of $M_2$, (e) said method resulting in a coating which is bonded to the substrate, said coating having an outermost dense layer of zirconium and/or hafnium oxide substantially free from $M_2$, an intermediate layer containing zirconium and/or hafnium oxide and $M_2$ and an innermost layer of $M_2$ alloyed with one or more metals from the substrate.

2. The method of claim 1 wherein the substrate metal is nobler than zirconium and hafnium.

3. The method of claim 2 wherein after step (d) the coating is annealed.

4. The method of claim 2 wherein the substrate metal is a superalloy.

5. The method of claim 2 wherein the first mentioned metal is zirconium.

6. The method of claim 2 wherein the first mentioned metal is hafnium.

7. The method of claim 2 wherein $M_2$ is selected predominantly from the group nickel, cobalt and iron.

* * * * *